US007836697B2

(12) United States Patent
Holden et al.

(10) Patent No.: US 7,836,697 B2
(45) Date of Patent: Nov. 23, 2010

(54) ROTARY STEAM ENGINE

(75) Inventors: John Holden, Billerica, MA (US); Richard Rehlander, Billerica, MA (US)

(73) Assignee: Torque Applications, Inc., Billerica, MA (US)

( * ) Notice: Subject to any disclaimer, the term of this patent is extended or adjusted under 35 U.S.C. 154(b) by 460 days.

(21) Appl. No.: 11/949,827

(22) Filed: Dec. 4, 2007

(65) Prior Publication Data

US 2009/0142211 A1 Jun. 4, 2009

(51) Int. Cl.
*F01K 1/00* (2006.01)
*F01C 1/00* (2006.01)

(52) U.S. Cl. ..... 60/670; 418/225; 418/241; 418/266

(58) Field of Classification Search ..... 60/670; 418/209, 224, 225, 241, 266–269
See application file for complete search history.

(56) References Cited

U.S. PATENT DOCUMENTS

| | | | | |
|---|---|---|---|---|
| 137,065 | A | 3/1873 | Fisher | |
| 525,121 | A | 8/1894 | Shepard | |
| 2,416,940 | A * | 3/1947 | Morton | 91/492 |
| 3,720,188 | A * | 3/1973 | Mead | 122/41 |
| 5,039,290 | A | 8/1991 | Nardi | |
| 7,080,512 | B2 * | 7/2006 | Schoell | 60/670 |
| 2005/0247282 | A1 | 11/2005 | Yuksel | |

FOREIGN PATENT DOCUMENTS

| | | |
|---|---|---|
| EP | 1 925 776 | 5/2008 |
| JP | 2002-227602 | 8/2002 |
| WO | 88/05120 | 7/1988 |

* cited by examiner

*Primary Examiner*—Hoang M Nguyen
(74) *Attorney, Agent, or Firm*—Steven M. Jensen; Edwards Angell Palmer & Dodge LLP

(57) ABSTRACT

A circular, reversible steam powered engine configured to force pistons mounted in circular housing assembly and coupled to a main shaft to create a work load. The steam powered engine is arranged to pipe steam of a high pressure into steam chambers to force pistons forward and push exhaust steam of a low pressure out of steam chambers. Gears rotate and engage with pistons to start and stop steam flow into timing valves and steam flow portions. The engine creates a torque required to effectively operate many types of loads, such as those for vehicle and equipment applications.

26 Claims, 7 Drawing Sheets

ROTARY STEAM ENGINE

TECHNICAL FIELD

The invention generally relates to a steam engine and methods of operating the steam engine, and more particularly, to a rotary expander positive displacement steam engine having pistons configured to move substantially continuously in a circular direction.

BACKGROUND OF THE INVENTION

Steam engines have been in existence for over 150 years. For many years, the best performing type of steam engine was the reciprocating piston driven steam engine. Only within the last fifty years has the turbine steam engine overshadowed the reciprocating piston driven steam engine in industrial use.

The drawbacks of the reciprocating piston steam engine include mass reversal of the piston as it reaches the maximum stroke. Also, the piston is unable to transmit full power during particular positions of the crankshaft. The piston also requires superheated steam to prevent water residue damage in the piston cylinder during operation. Super-heated steam is not efficient to produce. High friction seals are also required.

The drawbacks of the turbine steam engine include the need for high steam pressure to create blade movement and, like the piston steam engine, superheated steam is required to minimize erosion of the turbine blades. Also, large gear reduction assemblies are required to convert high RPM-low torque to low RPM-high torque.

Turbine steam engines are used in many industrial and military applications. For example, power companies use turbine steam engines in their power plants to generate electricity. Turbine steam engines also are used in nuclear-powered navel ships. In many applications using turbine steam engines, nuclear and coal-fired heat can be used to produce the steam.

Rotary expander steam engines are well known in the art. Early rotary expander steam engines are described in, for example, U.S. Pat. No. 137,065 to Fisher, and U.S. Pat. No. 525,121 to Shepard. In rotary expander steam engines, there is no reciprocating piston. Instead, each piston is coupled to a rotating wheel that moves continuously in a single direction. The piston slides or is engaged with the inner walls and surfaces of an steam tight enclosure. Steam is piped into the enclosure to pressurize inner chambers and to drive the piston forward, and steam is exhausted at other locations.

Rotary expander steam engines have certain technical advantages over conventional piston and turbine steam engines. For example, rotary expander steam engines do not require superheated steam during operation. Instead, they can use wet steam because the pistons move in a single direction and do not experience compression. In a wet steam environment, it is practical to use additives such as oil and antifreeze because wet steam will not break down the additives, unlike superheated steam.

Although many rotary expander steam engines have been conceived, existing expander steam engines are deficient due to complexities of the engine. For example, one of the biggest problems in conventional rotary expander steam engines is leakage, which can be difficult to overcome due to the complexity of the piston parts and housings. In particular, existing designs suffer from leakage of steam around the pistons, load shafts and inner engine housings. Furthermore, because steam pressure acts in all directions, it can be difficult to control pressure to directionally drive pistons rotationally forward.

SUMMARY OF THE INVENTION

The invention generally relates to a steam engine and methods of operating the steam engine, and more particularly, to a rotary expander steam engine having pistons moving substantially continuously in a circular direction. The engine can include a load shaft for driving a load, where the load shaft can be driven by one or more pistons. The pistons preferably are coupled to the main gears and are driven by steam pressure acting on one or more surfaces of the pistons.

According to the present invention, steam enters and leaves the engine at a predetermined timing, thereby optimizing operation of the steam engine. Steam can be delivered to the engine in a number of ways, including via tubes carrying superheated steam or wet steam from a boiler. The steam can be provided to certain parts of the engine using a number of timing methods and mechanisms. For example, the steam can be imported to timing valves with openings and closings for starting and stopping the steam. The configuration of the openings and closings can determine the timing of steam provided to the engine. The openings and closings can be aligned with openings and closings leading to the engine, such that steam is provided to the engine when the steam timing valve openings are aligned with one or more openings leading to the engine. When the steam timing valve openings are not aligned with openings leading to the engine, steam is cut off from the engine.

The engine can include a number of expanding or contracting steam chambers for receiving or exhausting the steam provided to the engine. The steam chambers can be formed by the inner housings of the steam engine and rotating pistons. For example, the steam can enter into one of the chambers in back of a piston. The pressure generated by the steam entering the chamber can drive the piston forward. The steam chamber formed on the other side of the piston (i.e., the non-driven side of the piston) can include steam which had previously entered the chamber and which is depleted and can be driven out of the engine through an exhaust portal by the piston as the piston rotates toward the portal. In addition to the force in back of the piston, the engine is also driven forward by centrifugal forces created by inertial forces of the rotating gears and engine components.

The pistons and main gears can further control the timing of steam into the engine. For example, the pistons can engage with gears coupled to the timing valves to stop the flow of steam to one of the chambers inside the engine. The main gears can also engage with the gears coupled to the timing valves to control steam flow. In this way, the engine can self-regulate the flow of steam to various parts of the engine.

According to the present invention, the steam engine is capable of responding to changes in steam pressure while preventing steam leakage and allowing substantially continuous movement of the pistons. According to one preferred embodiment of the steam engine, the pistons extend past the outer radius of the main gears and are in contact with the inner surface of the housing assembly. The pistons are received in recesses of the main gears to prevent steam leakage at the junctions of the pistons with the main gears. A piston pressure spring allows the piston to extend outward against the main gear in response to steam pressure inside the housing assembly. The pistons include a piston wheel that rotates along the inner surface of the housing assembly. The piston wheel is coupled to inner walls of the housing assembly through a center piston shaft with tips on either side. The tips are engaged with curved slots on the inner walls such that the piston wheel can both extend inward in outward in the housing assembly in response to changes in steam pressure inside the housing assembly. The piston wheel rides along a half-circle cutout at the end of the piston forming a steam tight seal on the forward and reverse side of the piston. This forms steam chambers on the forward and reverse side of the piston. In this embodiment, the main gear is in tight engagement with outer gears to further prevent steam leakage. The outer gear also has a cutout curved section to receive the piston as the piston rotates past the outer gear. Thus, a steam tight seal is maintained between the outer gears, main gears, and pistons. Further, the gears and pistons are sealed inside the housing assembly through a series of walls, forming steam chambers.

The pistons are maintained in steam tight engagement with the inner surface of the housing assembly by at least three prevalent forces: (1) the force of steam in back of the piston; (2) centrifugal forces generated by inertia of the rotating engine parts; and, (3) the radial force of the piston pressure spring.

Unlike a reciprocating engine which experiences mass reversal of the pistons, the rotary steam engine of the present invention includes pistons which substantially continuously move in one direction, allowing the rotary engine to be driven by wet steam. Lower temperature wet steam has advantages over superheated steam required by other types of steam engines. Wet steam is more efficient to produce than superheated steam. Also, wet steam can be mixed with lubricants to lubricate moving parts and reduce friction between engine surfaces. This can increase the life expectancy of engine parts and reduce the maintenance needs of the engine.

Further, the steam engine of the present invention is configured to self-regulate the flow of steam into the chambers of the engine. As the pistons rotate, they control the starting and stopping of steam into the steam chambers of the housing assembly, which provides work load to at least one portion of the engine, and exhausts steam from another portion of the engine. According to at least one preferred embodiment, pressurized steam enters on one side of the piston to drive the piston forward, while on the other side of the piston, spent steam or water is pushed out of the housing assembly through steam exhaust openings in the chambers. The piston can engage, either directly or indirectly, with steam timing valves to start or stop the flow of steam.

The steam engine of the present invention uses functionally equivalent, and thus substantially identical parts throughout the engine, which makes it possible to reverse the direction of the steam engine by reversing the flow of steam. According to at least one preferred embodiment of the steam engine, a lever is used to activate control valves for reversing the direction of steam. Thus, the steam input portions become the steam output portions and vice versa, and the engine is propelled in the opposite direction. Further, the substantially identical parts can make it possible to add and remove parts (such as steam valves) to increase or decrease work load capacity. This makes the engine adaptable to a wide range of applications, from heavy industry to residential applications.

Furthermore, because the engine preferably has identical parts throughout, the engine components can be replicated and repeated in series. In such an arrangement, a common main shaft could couple multiple rotary steam engines in series. Furthermore, the rotary steam engine is highly scalable to meet the power demands and other design requirements of the application.

The present invention, according to at least one preferred embodiment, is directed to a circular, reversible steam powered engine configured to push forward by force of steam pressure pistons coupled to a load shaft to create a work load. The steam engine creates a torque required to effectively operate many types of vehicles and equipment, including generators, automobiles, boats, aircraft, power plants, helicopters, tanks, and others.

According to the present invention, the steam engine includes a main shaft for driving a load and a housing assembly with an inner surface and through which the main shaft passes. The housing assembly includes at least one main gear, the at least one main gear being operably connected to the main shaft. The housing assembly also includes a plurality of pistons, each piston received radially in the at least one main gear, extending past the outer radius of the at least one main gear, and engaged with the inner surface of the housing assembly. Each piston is driven by steam pressure and pushes spent steam or water out of the steam engine. The housing assembly also includes a plurality of steam timing piston engaging members for engaging at least one of the pistons and for allowing the pistons to control the flow of steam into the steam engine. The steam engine also includes a plurality of steam flow controllers, each steam flow controller controlled by at least one of the pistons and at least one of the main gears to further control steam flow to the housing assembly. The steam engine also includes a plurality of outer gears shafts, each outer gear shaft operably coupled to at least one of the steam flow controllers to control starting and stopping of steam flow into the steam engine.

Another aspect of the invention is directed toward a steam-driven apparatus including a main shaft for driving a load and a piston housing assembly for receiving steam and driving the main shaft. The piston housing assembly includes one or more steam chambers, each steam chamber having a piston engaging portion. The piston housing assembly also includes one or more main gears, each main gear operably connected to the main shaft. The piston housing assembly also includes one or more pistons, each piston coupled to one of the main gears and having a portion extending beyond the outer radius of the one main gear. The piston includes a steam driven portion engaged with the piston engaging portion of the steam chambers The steam driven apparatus also includes one or more steam controllers for controlling the flow of steam into the steam chambers, the steam controllers coupled to one or more of the main gears and one of more of the pistons. Each steam chamber is formed on at least one side of each piston.

Another aspect of the invention is directed toward a machine including a load shaft for driving a load, a driving mechanism, and a steam control mechanism. The driving mechanism includes a rotating wheel coupled to the load shaft, and one or more pistons coupled to the rotating wheel. The steam control mechanism includes a steam flow controller for controlling the flow of steam to the driving mechanism.

A steam source provides steam to the driving mechanism exerting a driving force on one or more of the pistons at any one time during the energy cycle of the machine to rotate the wheel and load shaft. The engine self-regulates the flow of steam to a portion of the driving mechanism based on the engagement of one or more pistons with the steam control mechanism.

BRIEF DESCRIPTION OF THE DRAWINGS

For the present invention to be easily understood and readily practiced, preferred embodiments will now be described, for purposes of illustration and not limitation, in conjunction with the following figures.

DETAILED DESCRIPTION OF THE INVENTION

The present invention is directed to a circular, reversible steam powered engine or steam driven apparatus configured to push forward by force of steam pressure pistons coupled to a load shaft to create a work load. The engine creates a torque required to effectively operate many types of vehicles and equipment, including generators, automobiles, boats, aircraft, power plants, helicopters, tanks, and others.

The engine preferably is operated under a work load or governor control to prevent runaway over speed as there is no significant negative work such as friction or mass reversal to limit over speed runaway. The engine has substantially no work output (torque) during approximately 30° degrees of every full 360° degrees of main gear rotation to allow the piston to pass through the cutout portion of the small gear. Steam is cutoff behind the piston approximately 30° degrees before the piston reaches the small gear. When steam is cutoff, the engine uses stored energy generated by the mass of the rotating engine gears and the torque generated by the pistons on the other side of the wall to continue work output.

In a rotary steam engine, steam control and piston movement is critical throughout the engine's operative cycle. For example, at the end of the engine's operative cycle, the waste steam vapor or water must be exhausted and the pressure build-up caused by piston movement must be relieved. The engine must then enter the steam input portion of the operative cycle to continue driving pistons forward. This requires precise timing of steam shut-off and start up and must be carefully correlated with piston position and rotation within the engine. The pistons must be driven forward to continue supplying the work load.

Figure 1:
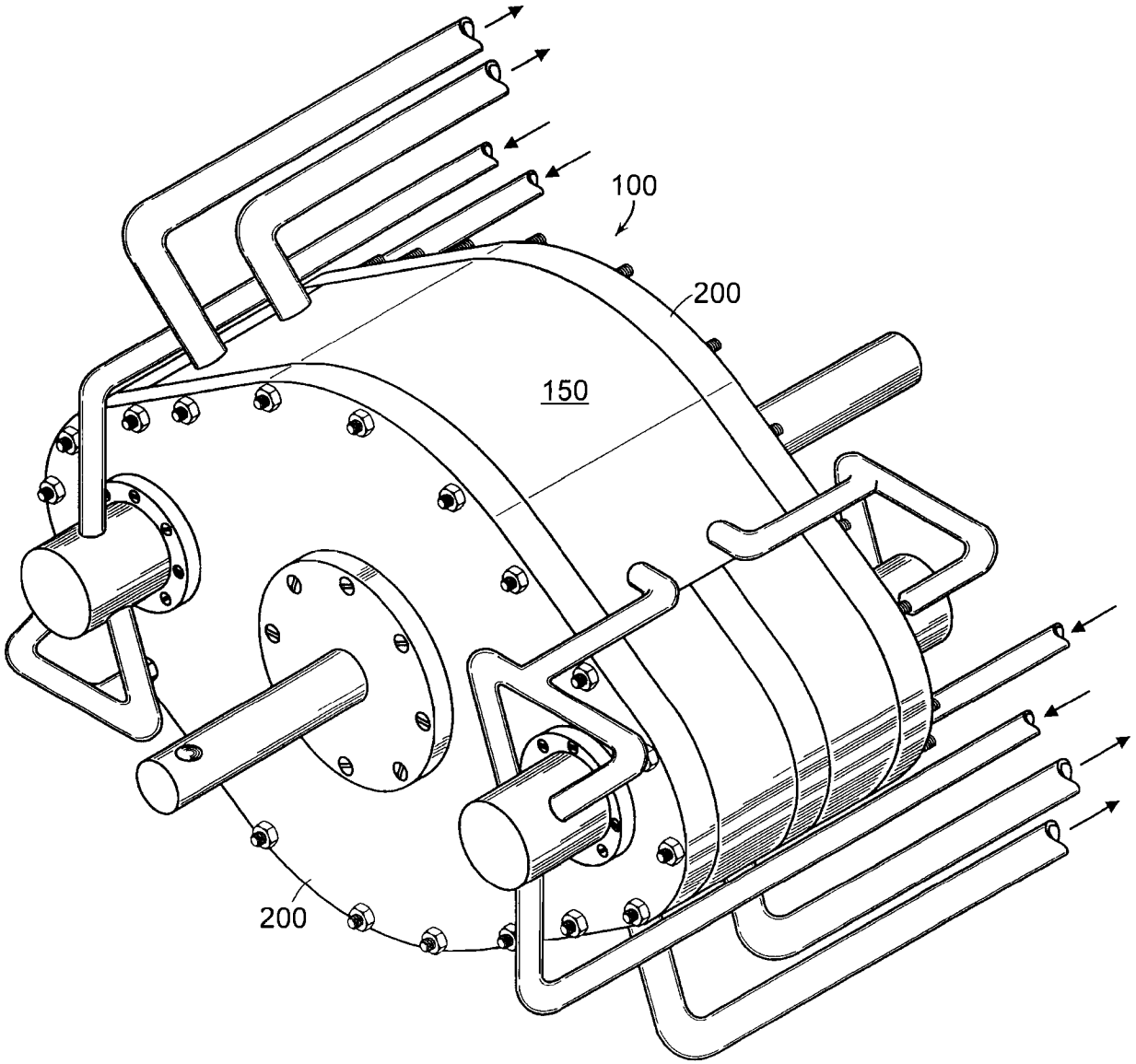
FIG. 1 illustrates a perspective view of a preferred embodiment of a steam engine showing a main shaft passing through the center of a housing frame assembly, steam timing valves, steam flow tubes, steam exhaust tubes, and outer frame components according to the present invention.
Figure 2:
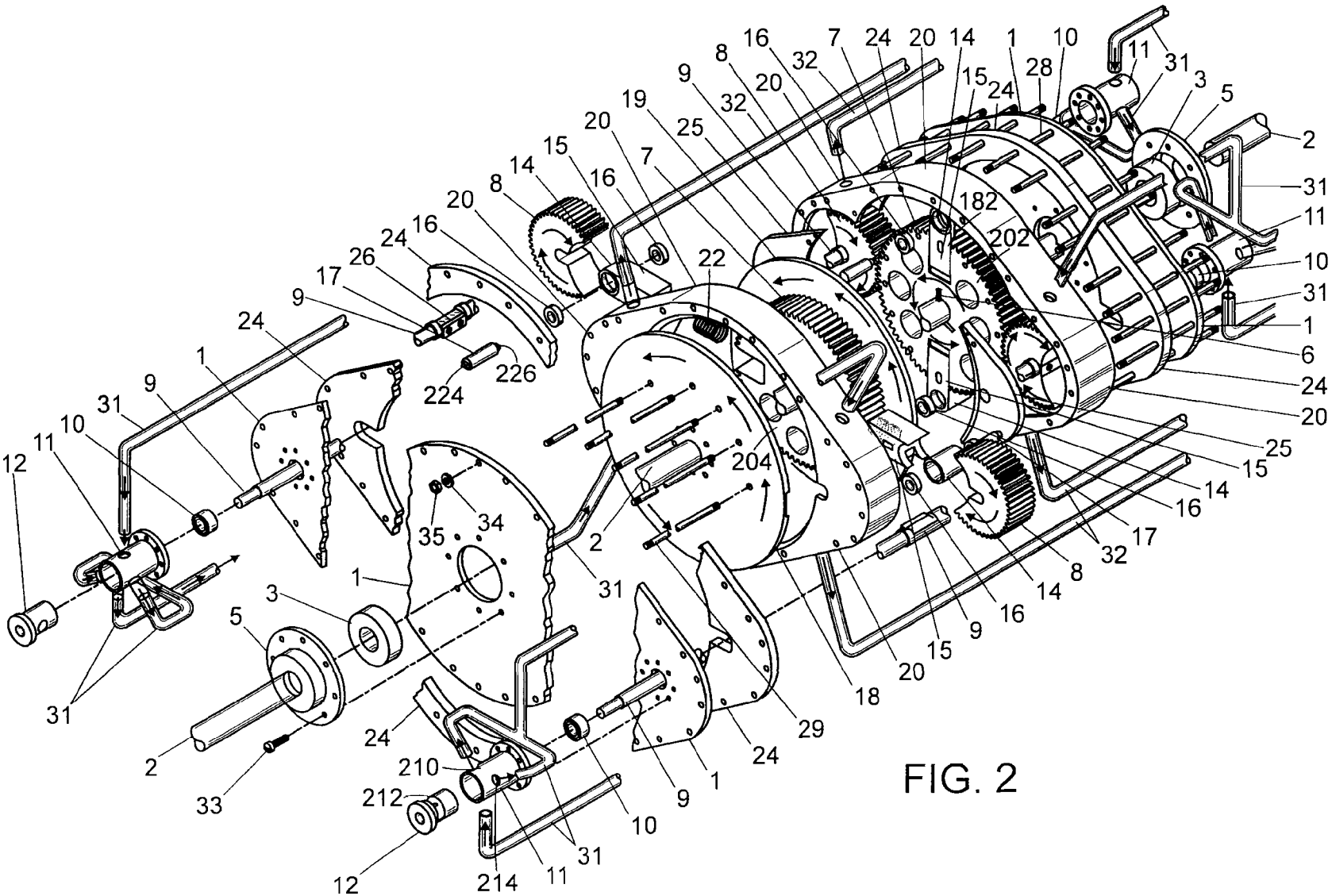
FIG. 2 illustrates an exploded parts view of the embodiment of FIG. 1, showing the two main gears coupled to the main shaft, four pistons coupled to each of the two main gears, three steam flow tubes, steam exhaust tubes, two outer shafts, four outer gears, two outer gears per outer shaft and other components.

According to the present invention, a steam engine 100 as shown in FIGS. 1 and 2 includes a main shaft 2 for driving a load and a housing assembly 150 with an inner surface 160 and through which the main shaft 2 passes.

The housing assembly 150 includes at least one main gear 7, the at least one main gear 7 being operably connected to the main shaft 2. The housing assembly 150 also includes a plurality of pistons 15, each piston 15 received radially 182 in the at least one main gear 7, extending past the outer radius 184 of the at least one main gear 7, and engaged with the inner surface 160 of the housing assembly 150.

Each piston 15 is driven by steam pressure and pushes spent steam or water out of the steam engine 100. The housing assembly 150 also includes a plurality of steam timing piston engaging members 170 for engaging at least one of the pistons 15 and for allowing the pistons 15 to control the flow of steam into the steam engine 100.

Another embodiment of the steam engine includes only a single piston. The single-piston engine would require a starter to start the engine when steam could not be supplied to the engine to start it, which would be the case if the steam engine had come to rest during a steam shutoff portion of the operative cycle.

The steam engine 100 also includes a plurality of steam flow controllers 12, each steam flow controller 12 controlled by at least one of the pistons 15 and at least one of the main gears 7 to further control steam flow to the housing assembly 160.

The steam engine 100 also includes a plurality of outer gear shafts 9, each of the outer gear shafts 9 operably connected to at least one of the steam flow controllers 12 to control the starting or stopping, or starting and stopping, of steam flow into the steam engine 100. In a further embodiment, the outer gear shafts 9 can be connected to the steam flow controllers using one or more outer gear shaft keys 13.

According to at least one embodiment of the steam engine, the steam engine is a rotary expander steam engine.

Preferably, the steam engine includes two main gears 7 and at plurality of steam flow tubes 31 which are coupled to at least one of the steam flow controllers 12. The steam flow tubes 31 direct steam into the steam flow controllers 12 and can direct steam from the steam flow controllers 12 to the housing assembly 150, or portions thereof. The steam engine further includes steam exhaust openings 196 in the housing assembly 150 for exhausting spent steam or water out of the steam engine 100.

Each of the steam timing piston engaging members 170 includes outer gears 8 which are operably connected to the outer shafts 9 and which engage with the main gears 7. In one embodiment of the steam engine, the main gears 7 and outer gears 8 have teeth along their outer edges for engaging with each other. In a further embodiment, the teeth of the main and outer gears are used to control the timing of gear rotation, including ensuring that the steam timing piston engaging portions engage at the proper time with the pistons.

Figure 3:
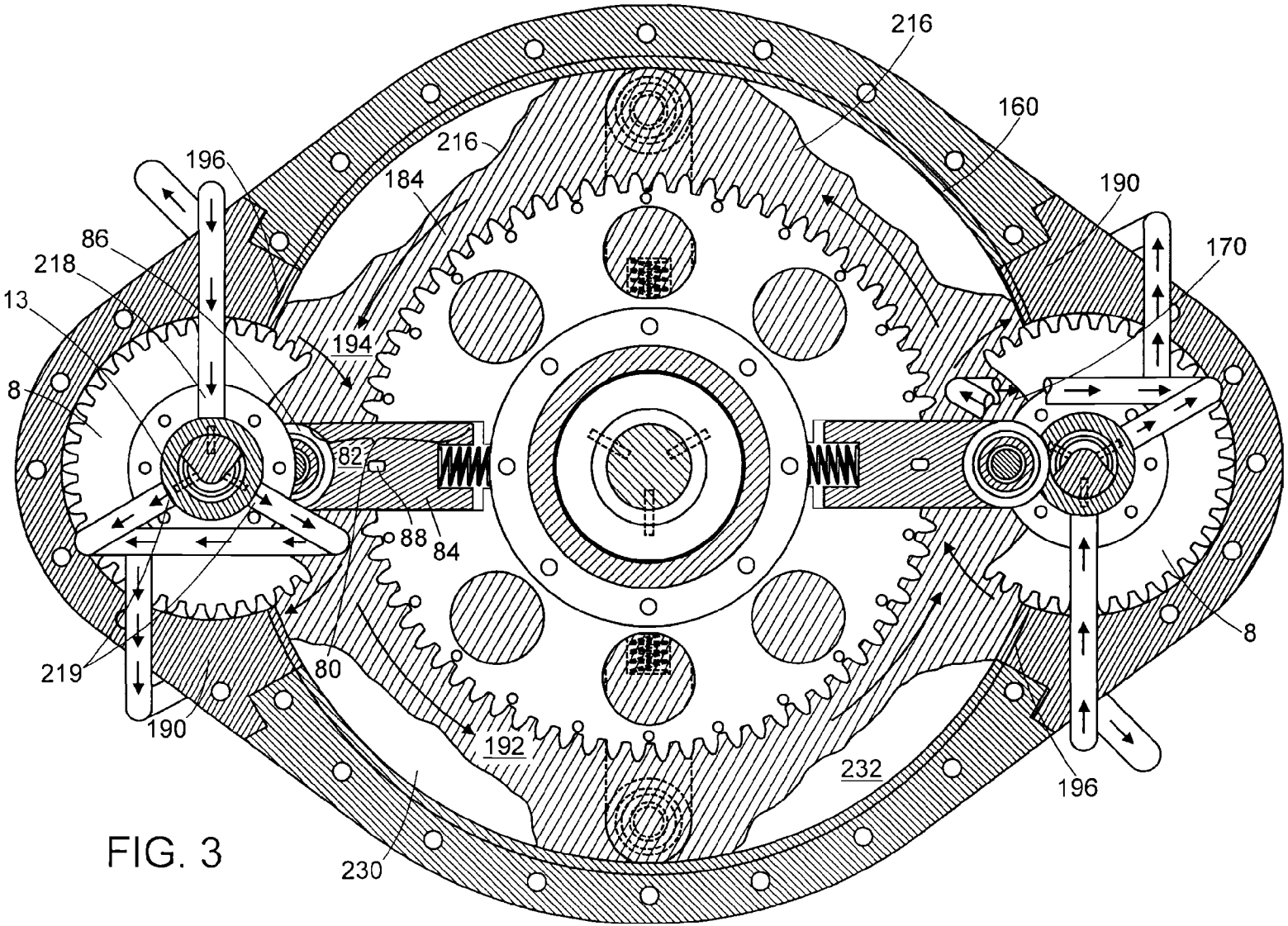
FIG. 3 illustrates a cross-sectional view of the embodiment of FIG. 1, showing the alignment of the pistons on one of the main gears and engaged with the piston engaging portions of the outer gears.

As shown in FIGS. 2 and 3, the outer gears 8 have a piston engaging portion 170 for engaging with the pistons 15 as the pistons 15 pass by the outer gears 8 during a portion of the engine's operative cycle. In one embodiment of the steam engine, the piston engaging portion 170 may be a curved cutout area of the outer gear 8 to receive an extended portion of the piston 15 as the piston passes by the outer gear 8. In this embodiment, once the piston 15 passes by the outer gear 8, the outer gear 8 reengages with the main gear 7 and the piston 15 comes into contact with the inner surface 160 of housing assembly 150.

The steam flow controllers 12 are coupled to the outer shafts 9 and are for controlling steam flow to the housing assembly 150 to drive the pistons 15 forward during a portion of the engine's operative cycle. Steam flows into the housing assembly 150 via the steam flow tubes 31 at various locations 190 timed with the rotation 192 of the pistons 15 and main gears 7. Preferably, the outer gears 8 engage with the main gears 7 and pistons 15, and the outer gears 8 rotate in an opposite direction 194 to the main gears 7 and pistons 15.

The steam exhaust openings 196 exhaust spent steam or water and relieve pressure within the housing assembly 150 during a portion of the engine's operative cycle. Steam exhausts from the housing assembly via the steam exhaust openings 196 at various locations.

Figure 5:
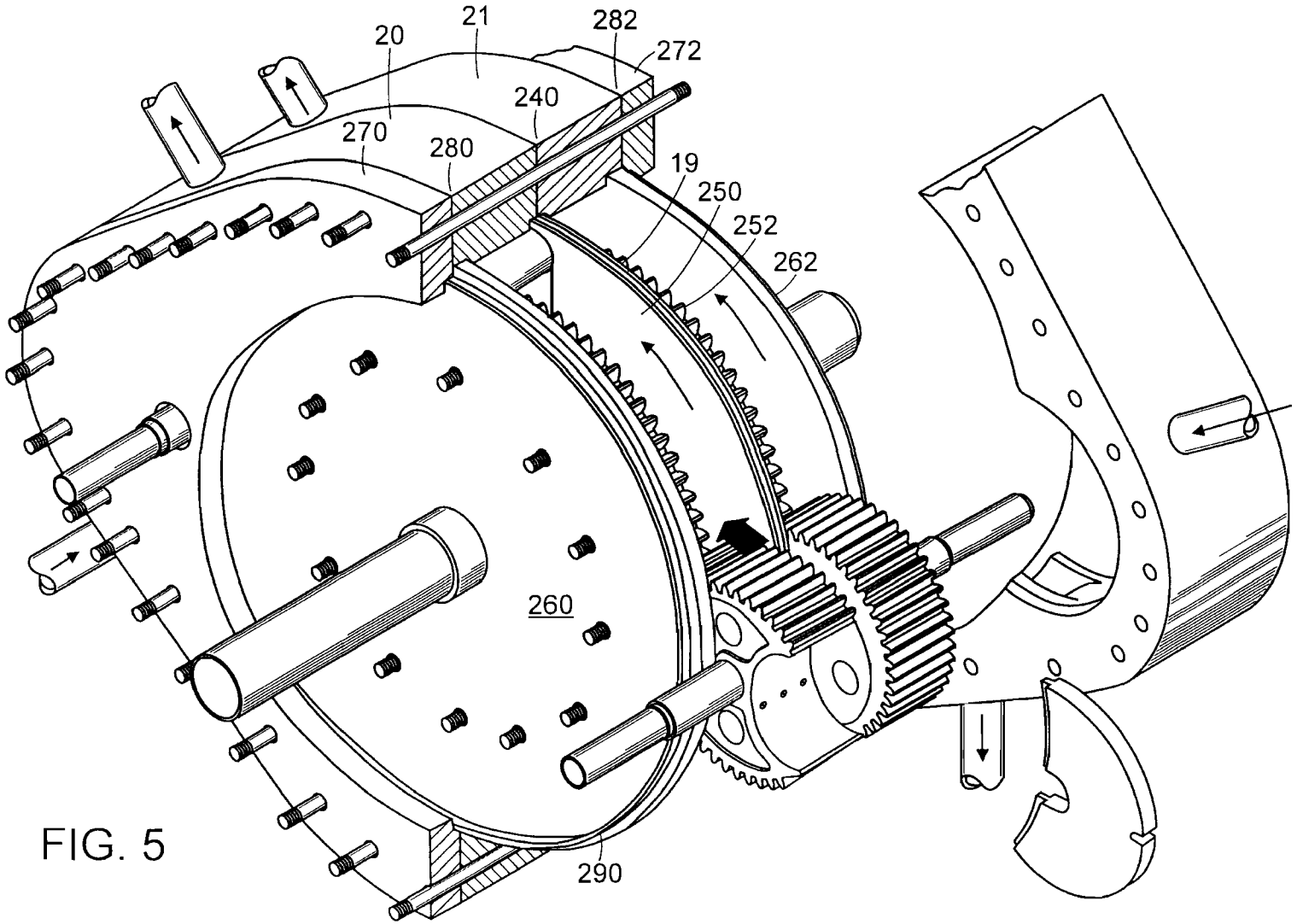
FIG. 5 illustrates an enlarged, exploded parts view of the embodiment of FIG. 1, showing the internal seals of the steam engine.

In at least one embodiment of the invention shown in FIG. 5, the housing assembly 150 further includes a first housing frame member 20 and a second housing frame member 21. The first and second housing frame members are coupled to each other 240. The housing assembly 150 further includes an inner face plate 19 having a first side 250 and a second side 252. The first side is coupled to one of the two main gears, and the second side is coupled to the other of the two main gears. The housing assembly 150 further includes a first outer face plate 260 and a second outer face plate 262. The first outer face plate 260 is coupled to the one main gear on the opposite side of the inner face plate 19. The second outer face plate 262 is coupled to the other main gear on the opposite side of the inner face plate 19. In this embodiment, the first housing frame member 20 is coupled to the inner face plate 19 and the first outer face plate 260, and the second housing frame member 21 is coupled to the inner face plate 19 and the second outer face plate 262.

In at least one embodiment of the invention, a plurality of main shaft keys 6 lock the main shaft 2 to the two main gears 7 forming a main gear/flywheel assembly.

In at least one embodiment of the invention, the steam engine includes an outer frame assembly 200. The outer frame assembly 200 includes a first and second outer wall 1 disposed on opposite sides of the steam engine and a first intersection member 270 and second intersection member 272. The first intersection member 270 is coupled to the first outer wall 1, and the second intersection member 272 is coupled to the second outer wall 1.

In this embodiment, the outer frame assembly 200 includes a first and second main shaft bearing housing 5 and a first and second main shaft bearing 3. The first main shaft bearing housing 5 is coupled to the first outer wall 1 and encloses the first main shaft bearing 3. The second main shaft bearing housing 5 is coupled to the second outer wall 1 and encloses the second main shaft bearing 3.

In this embodiment, the main shaft 2 operably rotates within the first and second main shaft bearings 3. Further, the first housing frame member 20 is coupled to the first intersection member 270 at 280 and the second housing frame member 21. The second housing frame member 21 is further coupled to the second intersection member 272 at 282.

The main shaft bearings can allow the steam engine to be mounted in any position, for example, horizontally or vertically.

According to a preferred embodiment of the steam engine, the outer walls, intersection members, and housing frames are connected to each other via a plurality of outer frame assembly connecting elements. In another embodiment of the steam engine, the plurality of outer frame assembly connecting elements may include a plurality of outer bolts 29, outer washers 34, and outer nuts 35 for bolting together the outer frame assembly.

In a further embodiment, the first intersection member is coupled to the outer surfaces of the first housing frame member and the first outer face plate, and the second intersection member is coupled to the outer surfaces of the second housing frame member and the second outer face plate.

In still a further embodiment, a first ring member 290 may be disposed between the first intersection member and first outer face plate within grooves of the first intersection member and first outer face plate to further provide a steam tight seal between the housing assembly and the outer frame assembly (an equivalent second ring member would be disposed similarly on the other side of the engine). The ring member can be comprised of Teflon or metal to seal and reduce friction between rotating components.

According to a preferred embodiment of the steam engine, the outer face plates, main gears, and inner face plate are connected to each other via a plurality of housing assembly connecting elements. Alternatively, the plurality of housing assembly connecting elements may include a plurality of inner bolts 29, inner washers 34, and inner nuts 35 for bolting together the housing assembly.

Preferably, as shown in FIGS. 2 and 3, the piston includes a piston arm 80, a piston wheel 14, and a piston pressure spring 22.

The piston arm 80 includes a distal end portion 82 and a proximal end portion 84. The proximal end portion is received radially 182 in one of the main gears.

The piston wheel 14 is received in a half circle cutout 86 of the distal end portion 82 of the piston arm 80. The piston wheel 14 includes a piston wheel shaft 17 and piston wheel bearing 16. The piston wheel bearing 16 allows the piston wheel 14 to operable rotate as the piston 15 rotates within the housing assembly 150.

The piston pressure spring 22 is received in a recess formed in the proximal end portion 84 of the piston arm 80 and is for maintaining the piston wheel 14 in tight engagement with the inner surface 160 of the housing assembly 150 and piston engaging portion 170 of the outer gears 8.

Figure 4:
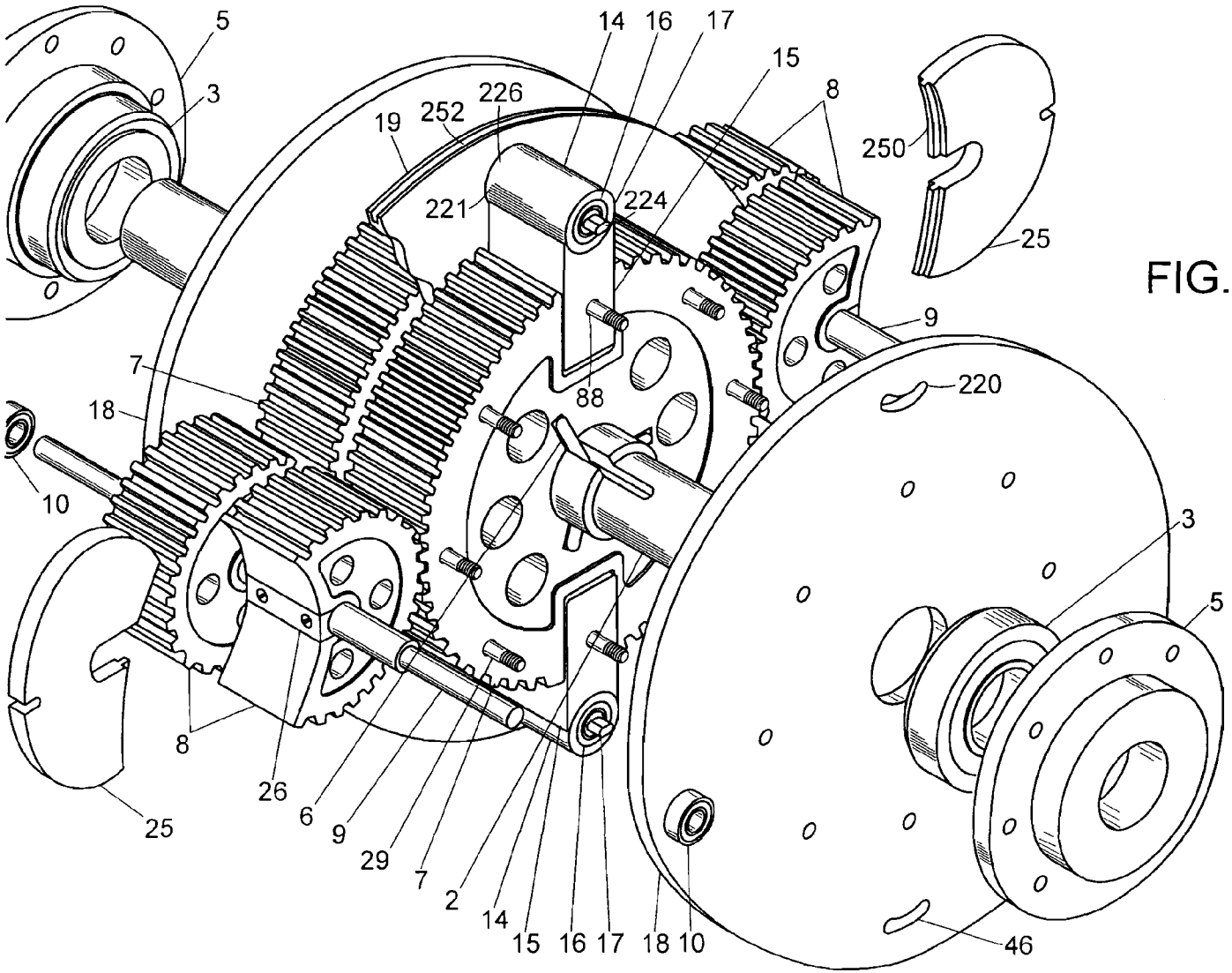
FIG. 4 illustrates an enlarged, exploded parts view of the embodiment of FIG. 1, showing the housing assembly and main shaft bearings of the steam engine.

In a further embodiment of the steam engine shown in FIG. 4, the pistons 15 are seated on one side in a recess of the inner face plate 19 to form a steam tight seal with the housing assembly 150. The first and second outer face plates 18 include a group of curved outer face plate slots 220. Also, each side of the inner face plate 19 includes a group of curved inner face plate slots 221. The piston wheel shaft 17 includes a first flat tip 224 on one end of the shaft, and a second flat tip 226 on the other end of the shaft. The first flat tip 224 is seated in one of the curved outer face plate slots 220 and the second flat tip 226 is seated in one of the curved inner face plat slots 221.

In this embodiment, the piston wheels 14 engage with the inner surface 160 of the housing assembly 150 and piston engaging portions 170 of the outer gears 8 to allow the piston wheels 14 to move outwardly along the slots in response to pressure changes. The piston wheels 14 are held in place by the half circle cutouts 86 at the distal end portion 82 of the piston arm 80 such that a steam tight seal is always formed. Also, centrifugal forces of the engine and the radial force of the piston pressure spring assist in holding the piston wheel in place and in steam tight engagement with the inner surface of the housing assembly. Further, the piston pressure spring allows the piston wheel to move slightly due to machining variances of the surfaces.

In a further embodiment of the steam engine shown in FIG. 4, each piston arm 80 further includes a slotted hole 88 for receiving a housing assembly connecting element and for allowing radial movement of the piston 15 in response to pressure changes within the housing assembly 150.

A further embodiment of the steam engine includes a first, second, third, and forth piston 15. The first and second piston are positioned 180 degrees apart (on opposite sides) on one main gear 7. The third and fourth piston are positioned 180 degrees apart on the other main gear 7. Furthermore, the two pistons mounted on the one main gear are 90 degrees out of phase from the two pistons on the other main gear. At any one time, at least one of the pistons is driven forward by the force of steam pressure on the backward side of the piston and spent steam or water is exhausted on the forward side of the piston by the forward movement of the piston. For this to happen, steam is provided to the housing assembly on the backward side of the piston according to opening and closing of the steam flow controllers in concert with piston movement. Further, the spent steam or water is exhausted from the housing assembly on the forward side of the piston via openings in the housing assembly.

In at least one embodiment of the steam engine, a group of outer gear shafts 9 includes first and second outer gear shafts, each positioned on opposites sides of the two main gears 7. Furthermore, the steam engine further includes four outer gears including a first and second outer gear 8 engaged with one of the main gears 7 on opposite sides, and a third and fourth outer gear 8 engaged with the other of the main gears 7. The first and third outer gears 8 are operably connected to the first outer gear shaft 9, and the second and fourth gears 8 are operably connected to the second outer gear shaft 9.

In a further embodiment of the steam engine, each outer gear shaft 9, includes a first and second outer gear shaft bearing housing 11 which allow the outer gear shafts 9 to operably rotate. The first outer gear shaft bearing housing 11 is coupled to the first outer wall 1 and encloses a first outer gear shaft bearing 10. The second outer gear shaft bearing housing 11 is coupled to the second outer wall 1 and encloses a second outer gear shaft bearing 10. Each of the outer gear shafts 9 operably rotates within the first and second outer gear shaft bearings 10. The outer gear shaft bearing housings may be coupled to the outer wall in any number of ways, including screws and/or adhesive.

In a further embodiment of the invention, the housing assembly 150 further includes a first and second intersection member extension 25 on opposite sides of the steam engine. The first and third outer gears 8 are coupled to the first intersection member extension 25. The second and fourth outer gears 8 are coupled to the second intersection member extension 25. Furthermore, the first and second intersection members 25 are coupled to the inner face plate 19, maintaining the outer gears in tight engagement with the inner surface 160 of the housing assembly 150 and preventing steam leakage. In this embodiment, the piston engaging portion 170 of the first outer gear 8 on the first outer gear shaft 9 is 180 degrees out of alignment with the piston engaging portion 170 of the second outer gear 8 on the second outer gear shaft 9, and is 180 degrees out of alignment with the piston engaging portion 170 of the third outer gear 8 on the first outer gear shaft 9, and the piston engaging portion 170 of the first outer gear 8 is aligned with the piston engaging portion 170 of the fourth outer gear 8 on the second outer gear shaft 9. In this way, the pistons 15 coupled on opposite sides of each main gear 7 simultaneously engage with the piston engaging portions 170 of the outer gears 8 on opposite sides of each main gears 7. Also, the pistons 15 on one main gear 7, which are 90 degrees out of phase with the pistons on the other main gear, are not simultaneously engaged with the piston engaging portion 170 of the outer gears 8 on the other main gear 7.

In a further embodiment shown in FIG. 4, the first and second intersection member extensions 25 have inner edges with projections 250. These projections 250 are received within a groove 252 along the outer edge of the inner face plate 19 forming a labyrinth seal between the inner face plate and the first and second intersection member extensions on either side of the engine. The labyrinth seal forms a steam tight seal and allows the inner face plate to rotate while in tight engagement with the intersection member extensions. In another embodiment, the labyrinth seal includes a plurality of projections in the intersection members and at least two corresponding grooves in the inner face plate coupled with the projections.

Furthermore, steam in the forward steam chamber pushes the outer gear against the inner wall of intersection member extension, further preventing steam leakage from one steam chamber to another across the piston and outer gear.

The outer gears can be coupled to the outer shafts at an inner engaging portion of the outer gears, wherein during assembly, the outer gear is slid over the outer shaft via the inner engaging portion of the outer gear. The inner engaging portion can be disposed in the mid-section of the piston engaging portion of the outer gear. In one embodiment, the outer gear is coupled to the outer shaft by a locking member disposed within and flush with the inner engaging portion of the outer gear. The locking member may have a t-shaped cross-sectional area for sliding into the inner engaging portion of the outer gear and for coupling the lateral portions of the locking member with the outer gear such that the surface of the locking member is flush with the surface of piston engaging portion of the outer gear. This allows the piston to pass by the locking member uninterrupted.

One or more bolts may be used to secure the locking member to the outer gear. The locking member is not limited to the aforementioned t-shaped configuration, and may be, for example, a member that slides into the inner engaging portion of the outer gear, wherein bolts or shaft keys are used to secure the locking member to the outer shaft to prevent or minimize radial movement of the outer gears.

In at least one embodiment of the steam engine, the steam flow controllers 12 are hollow tubes enclosed with an extended tubular portion 210 of one of the outer gear shaft bearing housings 11. The walls of the steam flow controllers 12 have a cutout portion 212. The cutout portion 212 is in alignment with a group of openings 214 in the extended tubular portions 210. Steam flows into one or more of the steam flow tubes 31 from a steam source, such as a boiler for heating water. Steam passes into the steam flow controllers 12 and into one or more steam flow tubes 31 when the cutout portion 212 of the steam timing valves 12 is rotated to be in alignment with the openings 214 in the extended tubular portion 210 of the outer gear shaft bearing housings 11 (enclosing the steam flow controllers 12). Steam flows into one or more steam chambers 216 of the housing assembly 150. Spent steam or water exits from the one or more steam chambers 216 in the housing assembly 150 through the one or more steam exhaust tubes 32.

The steam flow controller are not limited to hollow tube configurations and may include other configurations such as gates, flaps, doors, and sliding mechanisms. Further, the outer gear bearing housings are not limited to extended tubular portions for enclosing the steam flow controllers and may include other configurations such as shaped enclosures.

In a further embodiment of the steam engine, each of the extended tubular portions 210 of the outer gear bearing housings 11 has a steam input opening 218 and two steam output openings 219. The steam flow controllers 12 are rotated by the outer gear shafts 9 such that steam is cutoff during a steam shutoff rotational period of a portion of the steam engine's operative cycle when the cutout portion 212 of the steam flow controller 12 is not in alignment with the steam input opening 218. This period can correspond to the time in which the piston 15 is engaged with the piston engaging portion 170 of the outer gear 8.

In this embodiment, steam is allowed to flow from the steam input opening 218 to at least one of the two steam output openings 219 during a steam flow rotational period of a portion of the steam engine's operative cycle when the cutout portion 212 of the steam flow controller 12 is in alignment with the steam input opening 218.

In a further embodiment of the steam engine, the steam input opening 218 is connected to a steam source for supplying superheated or wet steam to the steam engine via at least one of the steam flow tubes 31. Steam flows from the steam output openings 219 into the housing assembly 150 via the steam flow tubes 31 coupled to at least one opening 190 in the housing assembly 150.

In a further embodiment of the steam engine, steam enters into at least one steam input chamber 230 of the housing assembly 150 via at least one of the steam flow tubes 31. Steam exhausts from at least one steam exhaust chamber 232 of the housing assembly 150 via at least one of the steam exhaust tubes 32. In this embodiment, the steam input chamber 230 is on the backward side of the piston 15 and the steam exhaust chamber 232 is on the forward side of the piston 15. In this way, the piston 15 is pushed forward rotationally by steam entering into the steam input chamber 230, and the piston pushes steam out of the steam exhaust chamber 232 as the piston 15 rotates forward toward at least one steam exhaust opening 196 in the steam exhaust chamber 232.

During operation of the steam engine, steam pressure is piped in at various locations 190 of the housing assembly 150. In one embodiment of the steam engine having four outer gears 8 described above (two outer gears on each side of the two main gears), steam is piped in at four locations 190 in front of each outer gear 8, or two locations for each main gear 7.

Steam pressure builds up in front of each outer gear 8 and in back of each piston 15 rotating or positioned in front of the outer gear 8. Pistons 15 on one main gear are 90 degrees out of phase with pistons 15 on the other main gear, providing continuous steam pressure to at least one steam input chamber 230 of the main gear section in the housing assembly 150. In this way, at least one piston 15 is pushed forward by steam pressure at any one time of the steam engine's operative cycle.

A piston 15 under pressure completes an approximately 150 degree rotation before steam to the steam input chamber 230 of the main gear section in back of the piston 15 shuts off due to engagement of the next piston 15 with the piston engaging portion 170 of the outer gear 8 during approximately 30 degrees of piston rotation. This cuts off steam in back of the piston 15 due to the blockage of steam into the steam flow tubes 31 from the steam timing valves 12. During the 180 degree rotation, steam forward of the piston is continually exhausted through the steam exhaust tube 32 and steam exhaust openings 196 forward of the piston 15.

As the piston 15 approaches the outer gear 8, the piston engaging portion 170 of the outer gear 8 is exposed and receives the piston 15 as the piston 15 passes by the outer gear 8. After the piston 15 passes by the outer gear 8, the piston 15 reengages with the inner surface 160 of the housing assembly 150, and the outer gear 8 reengages with the main gear 7.

During the time the piston 15 passes by the outer gear 8 and is engaged with the piston engaging portion 170 of the outer gear 8, the opposing outer gear 8 which is 180 degrees out of phase (and operably connected to the same outer gear shaft 9) is engaged with the other main gear 7. The piston 15 on the other main gear 7, which is 90 degrees out of phase, is pushed forward by steam pressure on its backward side, providing continuous rotation of the steam engine and work load.

The steam timing valves 12 operably connected to the outer shafts 9 provide the exact moment that the steam shuts off and starts up at a specific location inside the steam engine. As the outer gears 8 rotate, caused by the rotation of the main gears 7, the steam timing valves 12 also rotate. When the piston 15 engages with the piston engaging portion 170 of the outer gear 8, the steam timing valve 12 stops the input of steam into the steam input chamber 230. When the piston 15 has passed by the outer gear 8, the steam timing valve 12 starts the input of steam into the steam input chamber 230. The remaining steam in the steam output chamber 232 from the last steam input cycle is simultaneously exhausted to the steam exhaust tubes 32.

From the steam exhaust tubes, the saturated steam or wet steam can be directed to a condenser where it is converted back to water and then directed to the boiler for reuse. It is more efficient for the condenser to convert lower temperature steam or wet steam back to water than super-heated steam.

In a preferred embodiment, the invention is directed toward a steam driven apparatus shown in FIGS. 1-5, including a main shaft for driving a load, a piston assembly, a first and second outer shaft, a first, second, third, and fourth outer gear, and a first, second, third, and fourth steam controller.

The piston assembly is for receiving steam and driving the main shaft. It includes a first main gear and a second main gear. The first and second main gears are coupled to opposite sides of an inner face plate. The inner face plate has a groove along the outer edge. The outer side of the first main gear is coupled to a first outer face plate and the outer side of the second main gear is coupled to a second outer face plate. The first and second outer face plates are further coupled to each other, forming an outer frame of the piston assembly.

The piston assembly also includes a first, second, third, and four piston. The first and second pistons are coupled radially to the first main gear and are spaced 180 degrees apart. The third and fourth pistons are coupled radially to the second main gear and are spaced 180 degrees apart. Further, the first and second pistons are 90 degrees out of phase with the third and fourth pistons. Further, each of the pistons extend radially beyond the outer edges of the main gears.

Each of the pistons include a piston arm with a cutout portion for receiving a piston wheel. The piston wheel is engaged with the inner surface of the piston assembly and has a piston rod with a left and right tip for sliding within one of four slots of the inner face plate and one of four slots of each of the outer face plates. The piston rod left and right tips are for allowing the piston roller to slide outwardly along the slots and the cutout portion of the piston arms. This maintains a steam tight seal between the pistons and the inner surface of the piston assembly, boosted by the steam pressure where the higher the pressure, the tighter the seal.

Each piston also includes a piston spring disposed in an inner recess of one of the main gears. The piston spring is for pushing the piston radially outward to further maintain a steam tight seal between the piston and the inner surface of the piston assembly, and ensures a seal on startup of steam pressure. Also, variations of machine tolerances are compensated for.

The first and second outer gears are coupled to opposite sides of a first outer gear face plate. The first and second outer gears form a first outer gear assembly. The third and fourth outer gears are coupled to opposite sides of a second outer gear face plate. The third and fourth outer gears form a second outer gear assembly. The first and second outer gear assemblies are disposed on opposites of the main gears and are coupled on their outer sides to the piston frame. Also, the first and second outer gear face plates have a protrusion along the edge facing the inner face plate. This edge is disposed within the inner face plate groove forming a labyrinth seal. The first outer gear assembly is rotably coupled to the first outer shaft and the second outer gear assembly is rotably coupled to the second outer shaft.

Each of the outer gears further includes a piston engaging portion for engaging with each of two of the pistons as the pistons pass by the outer gear. The piston engaging portions of the first and second outer gears are 180 degrees apart and the piston engaging portions of the third and fourth outer gears are 180 degrees apart.

The first, second, third, and fourth steam controllers are for controlling steam input and cutoff to expanding and contracting steam chambers of the piston assembly formed in front of and in back of each of the pistons. The first and second steam controllers are coupled to the first outer shaft on opposite sides. The third and fourth steam controllers are coupled to the second outer shaft on opposites sides.

Each steam controller includes an extended tubular portion with an opening. Also, each steam controller includes two steam flow tubes coupled to the piston assembly along the piston frame. Steam flows from a steam source, through the steam controller, and to the piston assembly when the opening of the extended tubular portion is aligned with the steam source.

In this embodiment of the invention, steam is inputted into the piston assembly in back of the pistons, pushing the pistons forward. Spent steam or water is exhausted from the piston assembly in front of the pistons as the pistons push the steam out through steam exhaust openings in the piston frame.

The composition of the engine, at least in one embodiment of the invention, comprises four independent expansion chambers and four pistons connected to a common drive shaft. For maximum torque, all four expansion chambers can be connected to the same common steam input source. For increased efficiency, the spent steam output from one half of the engine can be connected to the steam inputs of the other half, effecting dual compound operation.

For further efficiency, the spent steam outlet from each independent expansion chamber can be connected to the steam inlet of each succeeding expansion chamber to effect quad compound operation. The dual and quad connections allow the engine to act like a condenser converting all the steam energy to shaft rotation and water.

In one aspect, the invention is directed to a machine including a load shaft for driving a load, a driving mechanism, and a steam control mechanism. The machine can include a steam engine or a valve.

The driving mechanism includes a rotating wheel operably coupled to the load shaft and one or more pistons coupled to the rotating wheel.

The steam control mechanism includes a steam flow controller for controlling steam to the driving mechanism. Steam is provided to the driving mechanism to exert a driving force on one or more pistons at any one time during the energy cycle of the machine. The driving force rotates the wheel and load shaft. The engine self-regulates the flow of steam to a portion of the driving mechanism based on the engagement of one or more pistons with the steam control mechanism.

In a further embodiment, the driving mechanism further includes one or more steam chambers formed on the forward and backward sides of each of the pistons. Also, the driving mechanism includes a plurality of walls for enclosing the pistons. The piston are in contact with the inner surfaces of the walls while maintaining a steam tight seal.

The steam flow controllers include two steam flow controllers which are outer wheels disposed on opposite sides of the rotating wheel. The steam flow controllers include a cutout section for engaging the pistons as the pistons rotate past the outer wheels In a further embodiment, the machine includes a roller for rolling along the inner surfaces of the plurality of walls. The roller is seated within a cutout section of the piston. The cutout section allows the roller to move forward or backward in response to pressure changes within the driving mechanism while maintaining steam tight seals within the steam chambers. The machine also includes a roller shaft coupled to curved slots in each of the outer walls. The curved slots allow the roller to move forward or backward in response to pressure changes within the driving mechanism while maintaining steam tight seals within the steam chambers. Also, the machine includes a piston spring coupled to the inner end portion of the piston and the rotating wheel. The piston spring allows the piston to move inward and outward in response to pressure changes within the driving mechanism while maintaining steam tight seals within the steam chambers.

In a further embodiment, the flow of steam to the machine's driving mechanism stops while the pistons rotate through the outer wheel.

In a further embodiment, the machine includes a plurality of driving mechanisms and a plurality of steam control mechanisms.

The rotary steam engine can instantly shift into a reverse or opposite direction from a rotational movement. The steam timing valves promoting rotation in a first direction can be reversed, allowing steam to change direction against the pistons.

To reverse rotational direction, a spring-loaded sliding stop valve is positioned to block steam input while allowing pressure to escape from a master valve. This action is maintained as long as no steam pressure is activated from the master valve. When the master valve is opened, the sliding stop valve is forced to slide, which opens the steam input port into the steam engine and, at the same time, closes the pressure escape port.

Figure 6:
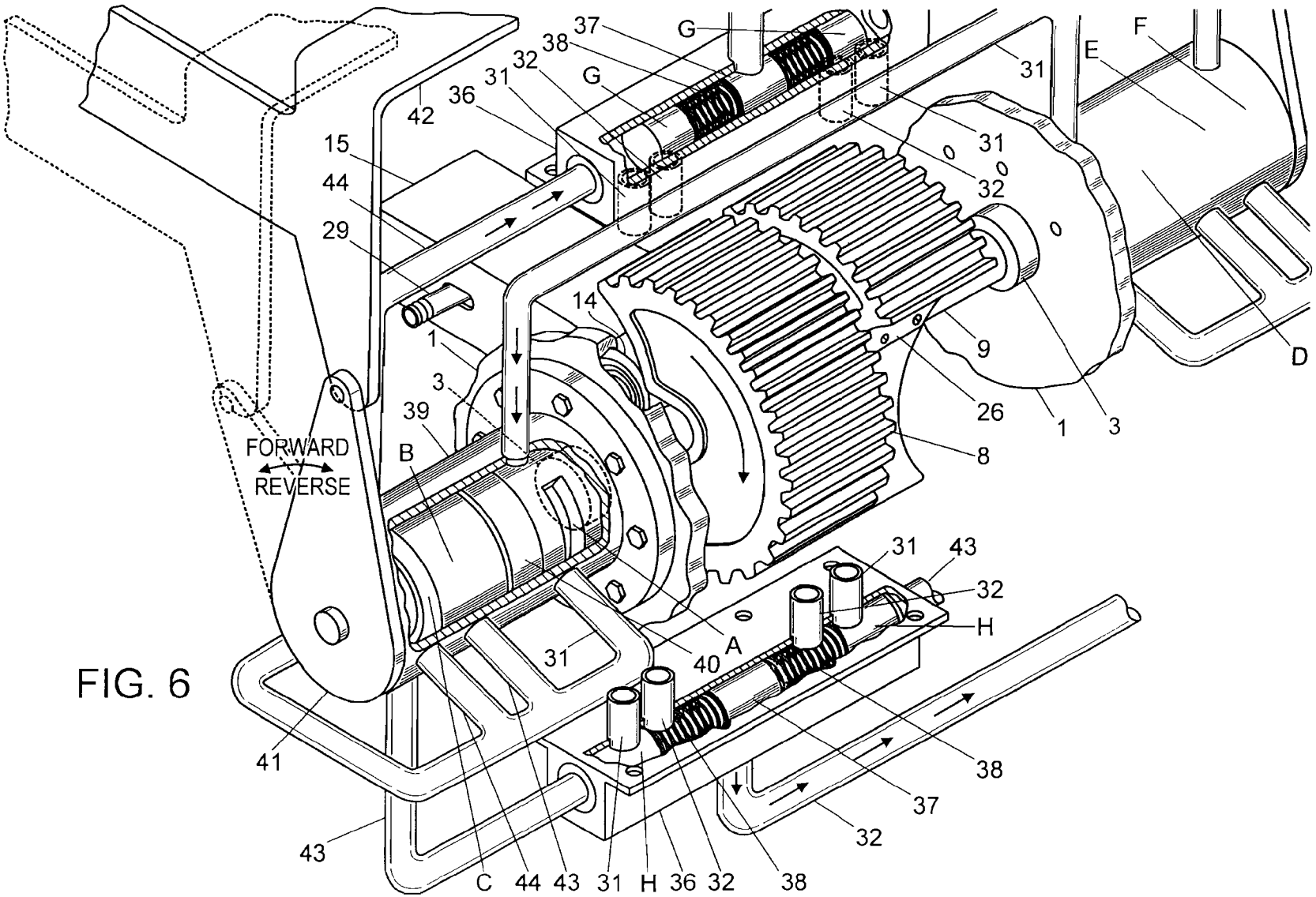
FIG. 6 illustrates an exploded parts view of another preferred embodiment of the steam engine capable of being operated under forward and/or reverse directional control.
Figure 6A:
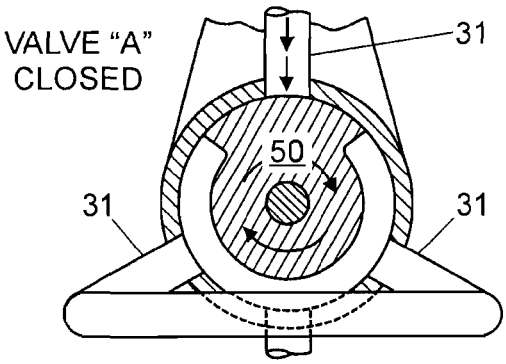
Figure 6D:
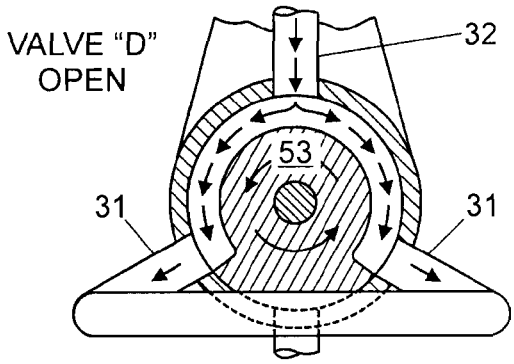
Figure 6B:
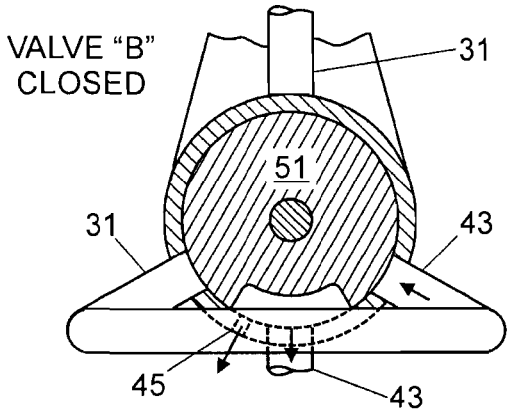
Figure 6E:
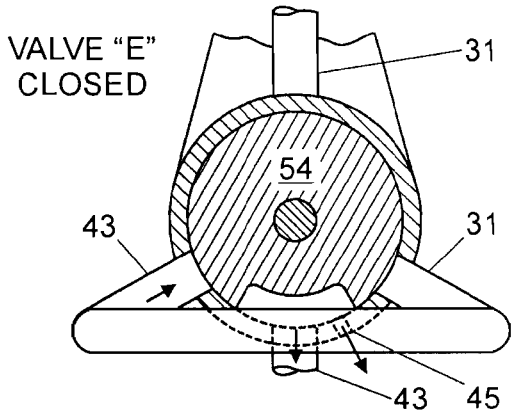
Figure 6C:
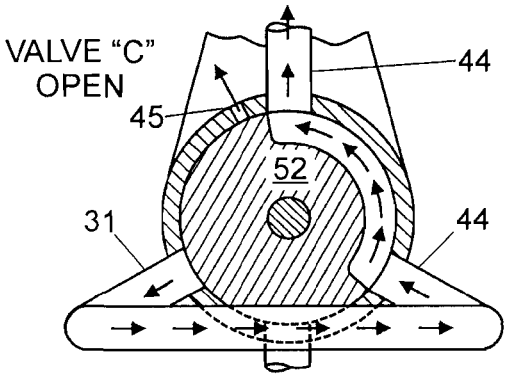
Figure 6F:
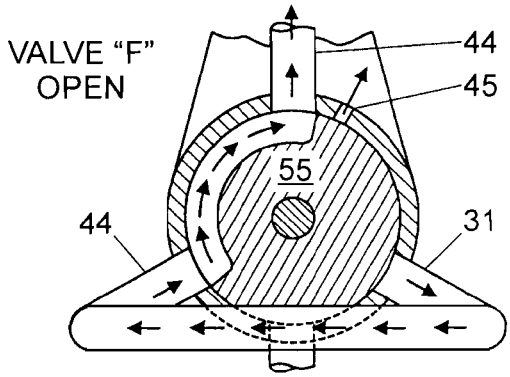

In one embodiment of the forward/reverse engine shown in FIG. 6, for any single sliding stop valve, four steam input ports open and four pressure escape ports close. The master valve has two ports enclosed in a rotary cylinder. When turning the cylinder in either a forward or reverse direction, only one of the two ports allows steam to enter a block of four steam input valves at a time.

The steam engine has identical parts throughout. This allows the engine to reverse direction by changing steam pressure into the opposite sides of the outer gear positions. The steam exhaust ports now become the steam input ports, whereas the steam input ports now become the steam exhaust ports.

Valving plays an important factor as steam must be diverted to the specific location at the proper time. This is accomplished by the extended outer gear shaft bearing housing where the outer portion encloses a valve which has dual steam release ports. The valve is controlled by a switching arm.

Moving the switching arm in one direction cause one valve port to open, allowing steam to flow through; and one valve port to close which resists steam action.

One valve port directs steam to one side of the engine for a specific shaft rotation. The other valve port directs steam to the opposite side of the engine for the reverse action of steam.

The ports for steam entry to the engine, as well as the ports for pressure exhaust, are enclosed within a single unit. Each unit has ports that line up and assemble to the engine ports for steam entry and pressure exhaust. In order to create interchangeability, each unit assembly has a sliding valve, which is spring loaded on one side. The opposite end of the valve aligns to a steam port entry. When there is no steam action at this port, pressure exhaust is allowed to pass through the open port on the spring side.

When the steam is applied to the steam port end, the spring valve is forced to slide due to steam pressure. This closes the pressure exhaust port and opens the steam entry port to the engine interior for action to the piston. There are four switching arms that activate simultaneously for exact timing, creating forward or reverse movement of the main engine shaft.

In at least one aspect of the steam engine capable of forward and reverse control, the outer gear bearing housing is extended to house further steam timing valves. In one embodiment, the outer gear bearing housing includes three steam timing valves, actions arms, and additional steam piping.

Steam is piped in at four locations which are the steam shut off valves. The steam shut off valves allocate the timing of steam to enter and shut-off during piston pass through of the outer gears. Forward or reverse action arms 41, which are interconnected by a common unit, are pushed to a vertical position (for forward motion). This causes the attached valves to align to interconnect steam ports 43 and 44 from the steam from the shut-off valves.

Four of the attached valves are activated to steam ports located at location near the outer gears. These steam ports, which are enclosed in a horizontal valve enclosure 36, have sliding steam input valves which are forced open by steam pressure as the adjacent pressure ports are closed in the same manner by port and stop valve 37. Each sliding valve is spring-loaded to remain in a closed position at the steam input port, unless steam pressure forces the valve to slide open which, at the same time, closes the adjacent pressure release valve.

Four steam chambers located near the outer gears have the steam valves activated. Also, four pressure release valves have ports that are closed. At the same time, four pressure release chambers remain open due to lack of steam required to closed the sliding valve to the ports. This complete action forces steam to the pistons causing rotational movement of the main gear/flywheel to provide work load to the main shaft.

For reverse motion, the action arms are pushed in a rear direction causing a section of the attached valves to line up for steam input, while at the same time shutting off the adjacent valve section currently in operation, which shuts off steam. This also allows excess steam pressure to exhaust out of a bleed slot 45 located in the valve track and allows the port and stop valve 37 to slide back by spring pressure, which opens the pressure release port 32 adjacent to the steam input port 31.

Steam from the steam input valve enters the adjacent valve section causing steam to advance to the opposite horizontal slide valves, which forces the slide valve to open to allow steam to enter the opposite side of the housing assembly for reverse action to the main gear/flywheel. At the same time, the pressure release port adjacent to the active steam port is closed, preventing steam pressure to escape at that location.

Although preferred embodiments of the invention have been described using specific terms, such description is for illustrative purposes only, and it is to be understood that changes and variations may be made without departing from the spirit or scope of the following claims.

What is claimed is:

1. A steam engine comprising:

a main shaft for driving a load;

a housing assembly with an inner surface and through which the main shaft passes comprising:

at least one main gear, the at least one main gear being operably connected to the main shaft;

a plurality of pistons, each piston received radially in the at least one main gear, extending past the outer radius of the at least one main gear, and engaged with the inner surface of the housing assembly, each piston driven by steam pressure and pushing steam out of the steam engine;

a plurality of steam timing piston engaging members for engaging at least one of the pistons and for allowing the pistons to control the flow of steam into the steam engine;

a plurality of steam flow controllers, each steam flow controller operably connected to at least one of the pistons and at least one of the main gears for controlling steam flow to the housing assembly; and a plurality of outer gear shafts, each outer gear shaft being operably coupled to at least one of the steam flow controllers to control at least one of starting and stopping of steam flow into the steam engine.

2. The steam engine of claim 1 wherein the steam engine is a rotary expander positive displacement steam engine.

3. The steam engine of claim 1 comprising two main gears and the steam engine further comprises:

a plurality of steam flow tubes, each of the steam flow tubes coupled to at least one of the steam flow controllers and for directing steam into the housing assembly;

a plurality of steam exhaust openings in the housing assembly for directing steam out of the steam engine; and each of the steam timing piston engaging members comprises: an outer gear operably connected to one of the outer gear shafts and engaged with one of the main gears and having a piston engaging portion for engaging at least one of the pistons.

4. The steam engine of claim 3 wherein the housing assembly further comprises:

a first housing frame member and a second housing frame member, the first housing frame member coupled to the second housing frame member;

an inner face plate with a first and second side, the first side coupled to one main gear and the second side coupled to the other main gear;

a first outer face plate coupled to the one main gear on the opposite side of the inner face plate; and a second outer face plate coupled to the other main gear on the opposite side of the inner face plate, wherein the first housing frame member is coupled to the first outer face plate and the inner face plate and the second housing frame member is coupled to the second outer face plate and the inner face plate.

5. The steam engine of claim 4 further comprising:

an outer frame assembly comprising:

a first and second outer wall disposed on opposite sides of the steam engine;

a first and second intersection member, the first intersection member coupled to the first outer wall, and the second intersection member coupled to the second outer wall; and a first and second main shaft bearing housing, the first main shaft bearing housing coupled to the first outer wall and enclosing a first main shaft bearing, and the second main shaft bearing housing coupled to the second outer wall and enclosing a second main shaft bearing;

wherein the main shaft operably rotates within the first and second main shaft bearings and the first housing frame member is coupled to the first intersection member, and the second housing frame member further coupled to the second intersection member.

6. The steam engine of claim 5 further comprising a plurality of housing assembly connecting elements for connecting the components of the housing assembly.

7. The steam engine of claim 5 wherein each piston further comprises:

a piston arm comprising a distal end portion and a proximal end portion, the proximal end portion being the portion of the piston received radially in one of the main gears;

a piston wheel received in a half circle cutout of the distal end portion of the piston arm and comprising:

a piston wheel shaft and a piston wheel bearing for allowing the piston wheel to operably rotate as the piston rotates within the housing assembly; and a piston pressure spring received in a recess formed in the proximal end portion of the piston arm and for maintaining the piston wheel in tight engagement with the inner surface of the housing assembly and piston engaging portion of the outer gears.

8. The steam engine of claim 7 wherein each piston is seated on one side in a recess of the inner face plate and on the other side in a recess of the adjacent outer face plate forming a steam tight seal with housing assembly and wherein:

the first and second outer face plates further comprise:

a plurality of curved outer face plate slots;

each side of the inner face plate further comprises:

a plurality of curved inner face plate slots;

the piston wheel shaft further comprises:

a first flat tip on one end of the shaft; and a second flat tip on the other end of the shaft, the first flat tip seated in one of the curved outer face plates slots and the second flat tip seated in one of the curved inner face plate slots, wherein the piston wheels engage with the inner surface of the housing assembly and piston engaging portions of the outer gears and are allowed to move outwardly within the slots in response to pressure changes but held in place by the half circle cutouts at the distal end portion of each of the piston arms such that a steam tight seal is always formed.

9. The steam engine of claim 7 wherein each piston arm further comprises a slotted hole for receiving a housing assembly connecting element and for allowing radial movement of the piston in response to pressure changes within the housing assembly.

10. The steam engine of claim 3 wherein the plurality of pistons includes a first and second piston spaced 180 degrees apart on one main gear, and a third and fourth piston spaced 180 apart on the other main gear, the two pistons of each gear 90 out of alignment with the two pistons of the other gear.

11. The steam engine of claim 5 wherein:

the plurality of outer gear shafts includes a first and second outer gear shaft, the first and second outer gear shafts positioned on opposite sides of the main gears; and the steam engine further comprises four outer gears including a first, second, third and fourth outer gear, the first and second outer gears engaged with one main gear on opposite sides, the third and fourth outer gears engaged with the other main gear on opposites sides, the first and third outer gears operably connected to the first outer gear shaft, and the second and fourth outer gears operably connected to the second outer gear shaft.

12. The steam engine of claim 11 wherein each outer gear shaft further comprises:

a first and second outer gear shaft bearing housing, the first outer gear shaft bearing housing coupled to the first outer wall and enclosing a first outer gear shaft bearing, and the second outer gear shaft bearing housing coupled to the second outer wall and enclosing a second outer gear shaft bearing, wherein each outer gear shaft operably rotates within the first and second outer gear shaft bearings.

13. The steam engine of claim 11 wherein the housing assembly further comprises:

a first intersection member extension; and a second intersection member extension, wherein the first and third outer gears are coupled to the first intersection member extension and the second and forth outer gears are coupled to the second intersection member extension, the first and second intersection member extensions are coupled to the inner face plate on opposites such that each of the first, second, third, and fourth outer gears are held in tight engagement with the inner surface of the housing assembly, and the piston engaging portion of the first outer gear on the first outer gear shaft is 180 degrees out of alignment with the piston engaging portion of the second outer gear on the second outer gear shaft and is 180 degrees out of alignment with the piston engaging portion of the third outer gear on the first outer gear shaft, and the piston engaging portion of the first outer gear is aligned with the piston engaging portion of the fourth outer gear on the second outer gear shaft.

14. The steam engine of claim 13 wherein each of the first and second intersection member extensions further includes an inner edge having a projection received within a groove along the outer edge of the inner face plate.

15. The steam engine of claim 12 wherein each of the steam flow controllers is a hollow tube enclosed within an extended tubular portion of one of the outer gear shaft bearing housings, the tubular walls of the steam flow controllers having a cutout portion in rotational alignment with a plurality of openings formed within the walls of the extended tubular portion of the outer gear shaft bearing housings, wherein the flow of steam into the housing assembly is controlled by the engagement of each of the cutout portions with at least one of the plurality of openings.

16. The steam engine of claim 15 wherein each of the extended tubular portions has a steam input opening and two steam output openings and wherein the rotation of each of the steam flow controllers controlled by one of the outer gear shafts is timed such that steam is cutoff during a steam shutoff rotational period in which one of the pistons is engaged with the piston engaging portion of the outer gear, and steam is allowed to flow from the steam input opening to at least one of the two steam output openings during a steam flow rotational period in which the outer gear is engaged with one of the main gears.

17. The steam engine of claim 16 wherein the steam input opening is connected to a steam source for supplying steam to the steam engine via at least one of the steam flow tubes and wherein each of the two steam output openings is connected to one of the steam flow tubes coupled to at least one opening in the housing assembly.

18. The steam engine of claim 17 wherein steam enters into at least one steam input chamber of the housing assembly via at least one of the steam flow tubes, the at least one steam input chamber formed on one side of at least one of the pistons, and steam exhausts from at least one steam exhaust chamber of the housing assembly via at least one of the steam exhaust openings coupled to at least one steam exhaust tube, the at least one steam exhaust chamber formed on the opposite side of the at least one piston.

19. A steam driven apparatus comprising:

a main shaft for driving a load;

a piston assembly for receiving steam and driving the main shaft, the piston assembly comprising:

a first main gear and a second main gear, the first and second main gear coupled to opposite sides of an inner face plate, the inner face plate having a groove along the outer edge, the outer side of the first main gear coupled to a first outer face plate and the outer side of the second main gear coupled to a second outer face plate, the first and second outer face plates further coupled to each other and forming an outer frame of the piston assembly;

a first, second, third, and four piston, the first and second piston coupled radially to the first main gear and spaced 180 degrees apart and the third and fourth piston coupled radially to the second main gear and spaced 180 degrees apart, wherein the first and second pistons are 90 degrees out of phase with the third and fourth pistons and wherein each of the pistons extend radially beyond the outer edges of the main gears and comprises:

a piston arm with a cutout portion for receiving a piston wheel, the piston wheel engaged with the inner surface of the piston assembly and having a piston rod with a left and right tip for sliding within one of four slots of the inner face plate and one of four slots of each of the outer face plates, the piston rod left and right tips for allowing the piston roller to slide outwardly along the slots and the cutout portion of the piston arms to maintain a steam tight seal between the pistons and the inner surface of the piston assembly; and a piston spring disposed in an inner recess of one of the main gears and for pushing the piston radially outward to further maintain a steam tight seal between the piston and the inner surface of the piston assembly;

a first and second outer shaft;

a first, second, third, and fourth outer gear, the first and second outer gear coupled to opposite sides of a first outer gear face plate and forming a first outer gear assembly, the third and fourth outer gear coupled to opposite sides of a second outer gear face plate and forming a second outer gear assembly, the first and second outer gear assemblies disposed on opposites of the main gears and coupled on their outer sides to the piston frame, wherein the first and second outer gear face plates have a protrusion along the edge facing the inner face plate and disposed within the inner face plate groove forming a labyrinth seal and wherein the first outer gear assembly is rotably coupled to the first outer shaft and the second outer gear assembly is rotably coupled to the second outer shaft, and each of the outer gears further comprises:

a piston engaging portion for engaging with each of two of the pistons as the pistons pass by the outer gear, wherein the piston engaging portions of the first and second outer gears are 180 degrees apart and the piston engaging portions of the third and fourth outer gears are 180 degrees apart; and a first, second, third, and fourth steam controller for controlling steam input and cutoff to expanding and contracting steam chambers of the piston assembly formed in front of and in back of each of the pistons, the first and second steam controllers coupled to the first outer shaft on opposite sides and the third and fourth steam controllers coupled to the second outer shaft on opposites sides, and each steam controller comprises:

an extended tubular portion with an opening; and two steam flow tubes coupled to the piston assembly along the piston frame, wherein steam flows from a steam source, through the steam controller, and to the piston assembly when the opening of the extended tubular portion is aligned with the steam source;

wherein steam is inputted into the piston assembly in back of the pistons, pushing the pistons forward, and steam is exhausted from the piston assembly in front of the pistons as the pistons push the steam out through steam exhaust openings in the piston frame.

20. A machine comprising:

a load shaft for driving a load;

a driving mechanism comprising:

at least one main gear, the at least one main gear being operably connected to the load shaft;

plurality of pistons received radially in the at least one main gear;

a plurality of steam timing piston engaging members for engaging at least one of the pistons and for allowing the pistons to control the flow of steam into the machine; and a steam control mechanism comprising:

a plurality of steam flow controllers, each steam flow controller operably connected to at least one of the pistons and the at least one main gear for controlling the flow of steam to the driving mechanism, wherein the steam provided to the driving mechanism exerts a driving force on one or more of the pistons at any one time during the energy cycle of the machine to rotate the at least one main gear and the load shaft, and the engine self-regulates the flow of steam to a portion of the driving mechanism based on the engagement of one or more pistons with the steam control mechanism.

21. The machine of claim 20 wherein the driving mechanism further comprises:

one or more steam chambers formed on the forward and backward sides of each of the pistons;

a plurality of walls for enclosing the pistons, the pistons in contact with the inner surfaces of the walls while maintaining steam tight seals; and the steam control mechanism comprises:

two steam flow controllers which are outer wheels disposed on opposite sides of the at least one main gear and comprising:

a cutout section for engaging the pistons as the pistons rotate past the outer wheels.

22. The machine of claim 21 wherein the pistons further comprise:

a roller for rolling along the inner surfaces of the plurality of walls, the roller seated within a cutout section of the piston, the cutout section allowing the roller to move forward or backward in response to pressure changes within the driving mechanism while maintaining steam tight seals within the steam chambers;

a roller shaft coupled to curved slots in each of the outer walls and allowing the roller to move forward or backward in response to pressure changes within the driving mechanism while maintaining steam tight seals within the steam chambers;

a piston spring coupled to the inner end portion of the piston and the at least one main gear and allowing the piston to move inward and outward in response to pressure changes within the driving mechanism while maintaining steam tight seals within the steam chambers.

23. The machine of claim 21 wherein the flow of steam to the driving mechanism stops when the pistons rotate past the outer wheel.

24. The machine of claim 22 comprising a plurality of driving mechanisms and a plurality of steam control mechanisms.

25. A method of operating a steam engine comprising the steps of:

providing a main shaft for driving a load;

providing a piston housing assembly for receiving and exhausting steam and driving the main shaft comprising:

at least one main gear, each main gear operably connected to the main shaft;

at least one piston; each piston coupled to one of the main gears and having a portion extending beyond the outer radius of the one main gear, each piston further comprising:

a steam driven portion; and a piston roller engaged with the inner surface of the piston housing assembly;

providing at least one steam controller, each steam controller engaged with at least one of the main gears and at least one of the pistons and comprising a steam import portion for accepting steam from a steam source;

directing steam to the at least one steam controller;

controlling the flow of steam from the at least one steam controller to the piston housing assembly comprising the steps of:

aligning the steam import portion of the at least one steam controller with at least one steam import opening of the piston housing assembly;

importing steam into the piston housing assembly in back of the steam driven portion of at least one piston to drive the piston forward; and exporting steam from at least one steam export opening of the piston housing assembly in front of the steam driven portion of at least one piston, the steam pushed out of the piston housing assembly by forward movement of the at least one piston.

26. The machine of claim 20 wherein the driving mechanism further comprises:

a plurality of outer gear shafts, each outer gear shaft being operably coupled to at least one of the steam flow controllers to control at least one of starting and stopping of steam flow into the machine.

* * * * *